US012366078B2

(12) United States Patent
Monty et al.

(10) Patent No.: US 12,366,078 B2
(45) Date of Patent: Jul. 22, 2025

(54) STRUCTURAL CONNECTOR FOR TENSIONING FLOOR JOISTS AND BEAMS

(71) Applicants: Stephen Monty, Bogangar (AU); Michael James Burchell, Runaway Bay (AU)

(72) Inventors: Stephen Monty, Bogangar (AU); Michael James Burchell, Runaway Bay (AU)

(73) Assignee: Burmon Holdings Pty Ltd., Paradise Point (AU)

( * ) Notice: Subject to any disclaimer, the term of this patent is extended or adjusted under 35 U.S.C. 154(b) by 236 days.

(21) Appl. No.: 18/130,977

(22) Filed: Apr. 5, 2023

(65) Prior Publication Data

US 2023/0358065 A1 Nov. 9, 2023

Related U.S. Application Data

(60) Provisional application No. 63/339,681, filed on May 9, 2022.

(51) Int. Cl.
*E04G 23/02* (2006.01)

(52) U.S. Cl.
CPC ..... *E04G 23/0285* (2013.01)

(58) Field of Classification Search
CPC . E04C 2003/026; E04C 3/02; E04G 23/0218; E04G 21/26; F16B 7/06
See application file for complete search history.

(56) References Cited

U.S. PATENT DOCUMENTS 2,623,246 A * 12/1952 Pestak ..... E04C 3/02 52/645
2,794,217 A * 6/1957 Croft ..... E06B 5/12 248/200.1
3,171,627 A * 3/1965 Tapley ..... B63B 25/24 410/151
3,284,050 A * 11/1966 De Meyer ..... A63B 60/44 24/135 N
3,990,139 A * 11/1976 Touchet ..... B25B 27/023 29/261
5,058,256 A * 10/1991 Taylor ..... B25B 27/062 29/260
5,193,940 A * 3/1993 Long ..... F16B 7/06 405/259.1
5,853,163 A * 12/1998 Chagnot ..... E04G 21/26 254/133 R
5,937,608 A * 8/1999 Kucirka ..... E04G 23/0218 52/693

(Continued)

*Primary Examiner* — Brian E Glessner
*Assistant Examiner* — Daniel J Kenny
(74) *Attorney, Agent, or Firm* — Vidas, Arrett & Steinkraus, PA; Richard A. Arrett; Edwin E. Voigt, II

(57) ABSTRACT

A structural connector having a tensioning bolt constructed and arranged for receiving two tension rods, each tension rod being axially adjustable within the tensioning bolt. Each tension rods has ends, with one end being rounded and the other end having an external hex drive profile. The two rods are arranged so the rounded ends are opposite each other. The structural connector is used to provide tension between two adjacent joists and the rounded end of each tension rod is received by a round hole of a pair of mounting brackets attached to the adjacent joists. Each tension rod is locked into a set tensioned position by a threaded nut.

3 Claims, 8 Drawing Sheets

(56) References Cited

U.S. PATENT DOCUMENTS

| | | | | |
|---|---|---|---|---|
| 6,920,724 | B1 * | 7/2005 | Hundley | E04B 1/24 52/656.1 |
| 7,097,154 | B2 * | 8/2006 | Stevens | F16B 7/06 254/233 |
| 7,699,874 | B2 * | 4/2010 | Young | A61B 17/705 606/280 |
| 7,748,180 | B1 * | 7/2010 | Plavidal | E04C 3/18 52/573.1 |
| 9,359,739 | B2 * | 6/2016 | Clements | E02D 5/80 |
| D767,983 | S * | 10/2016 | Jiang | D8/394 |
| 11,653,955 | B2 * | 5/2023 | Biedermann | A61B 17/7025 606/252 |
| 2002/0194808 | A1 * | 12/2002 | Ratliff | E04C 3/18 52/745.19 |
| 2009/0204156 | A1 * | 8/2009 | McClintock | A61B 17/7002 606/246 |

* cited by examiner

Figure 10
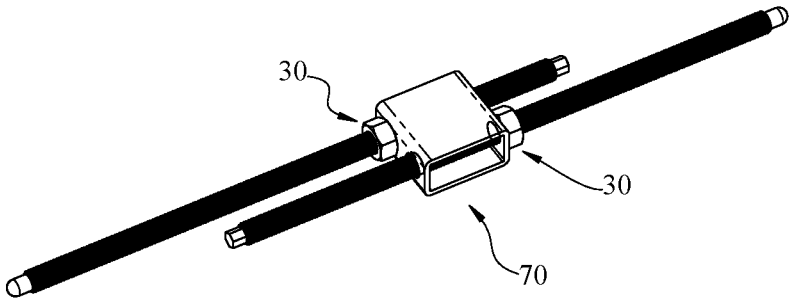
Figure 11
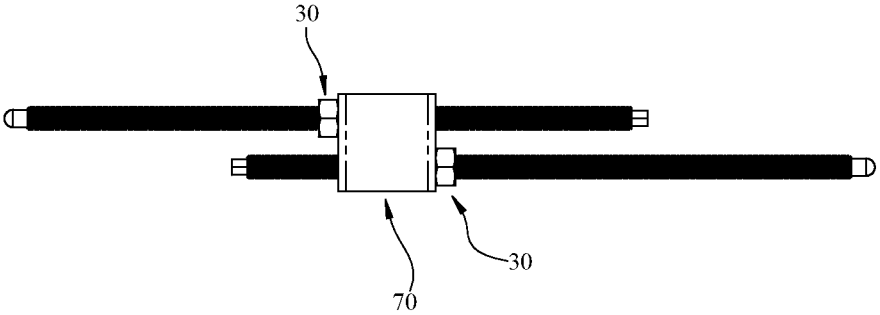

STRUCTURAL CONNECTOR FOR TENSIONING FLOOR JOISTS AND BEAMS

BACKGROUND

1. Field of the Invention

The invention relates generally to a structural connector for tensioning floor joists and beams

2. Background

There are currently multiple methods to brace floor joists in floor construction to overcome deformation and bouncy floors. A wide variety of bracing systems have been utilized with the design parameters being to prevent joists from moving out of alignment.

The most common method of bracing joists is to use wood members cut to the appropriate lengths to form cross bridging in between each joist. The problem with this system is over time, wood contracts and expands through heat and moisture penetration which results in wood warping losing its strength and stiffness. Cross bridging made from wood loses its structural integrity over time creating loose nail connections between the joist and the bridging resulting in squeaky and bouncy floors.

There are also multiple joist bracing systems made from steel. Conventional steel bracing systems can be more complex in design and therefore more costly to manufacturer. Combine the added material cost of steel with the added expense of requiring a professional contractor to install them, often means the homeowner will put up with the problem of bouncy floors rather than pay for a possible solution.

Conventional floor joist bracing systems are not designed to provide a significant tension force between each joist. Conventional floor joist bracing systems do not have the structural engineering capacity to raise an existing sagging floor to its original horizontal position.

Installing conventional floor joist bracing systems on existing sagging floors will not eliminate deflection which is the cause for bouncy and squeaky floors.

SUMMARY OF THE INVENTION

Floor joists are horizontal structural members that span and open space, often between beams, which subsequently transfer the load to vertical structural members. These joists, part of the floor system, carry the weight of everything inside a room, including walls, furniture, appliances and people.

Floor joists help distribute the load of a structure. When weight is applied to the floor and the joist, wood fibers on the bottom of the joist go into what is known as tension. The top fibers go into compression, and this help distribute load evenly. Over time, wood floors can lose their strength and stiffness because of moisture, wear and tear and increased loads placed upon the floor which creates bouncy and squeaky floors. To counteract this problem bracing between the joists is used to reduce deflection and bounce with limited success.

It is desirable to have a structural connector that is engineered to provide a tension force between the joists with the capacity and strength to lift sagging floors and floor joists to level.

Furthermore, it is desirable to have a structural connector that has the capacity to not only raise a sagging floor, but to act like a steel beam across the whole floor holding the raised floor in a horizontal position permanently under dead loads and live loads.

The components of conventional floor joist bracing systems are designed primarily to prevent joists from moving out of alignment which is an attempt to stiffen sagging floors and reduce floor bounce. The components of conventional floor joist bracing systems are not engineered to create a tension force sufficient to raise sagging floors and hold them into position under loads.

Thus, there is a need in the construction wood floor industry for an inexpensive, high capacity, high performance, adjustable and easily installable joist tensioning device. Furthermore, it would be desirable to have a device that has the tension force capacity to raise sagging joists and floors to a horizontal position. Still, further, it would be desirable to have a device that reduces deflection in a floor resulting in less bounce and vibration. The present invention meets these criteria.

Disclosed is a structural connector for tensioning adjacent joists and beams. The disclosed structural connector is made up of the following components. A pair of load bearing mounting brackets with tension rod receiver holes, an adjustable structural tensioning bolt which is internally threaded with dual openings to receive two tension rods. The structural tensioning bolt acts as a housing and a strengthening support for the tension rods. Two tension rods with each end being rounded to fit into the receiver holes of the mounting bracket and the other end being the driver end fitted with an external hex drive formation.

The device may also have a mounting bracket with shim placement holders. The shim mounting bracket version is an alternative embodiment to the standard mounting bracket. It has openings to receive shims which are designed to strengthen the connection of the floor to the joist therefore eliminating squeaks.

The disclosed device is unique because it has the functionality to provide a high-capacity tension force in between two adjacent joists, in the middle and centre where the tension force is needed the most. When installing the device across the whole floor, mid-span, the system works together lifting and holding a sagging floor to its original levelness and stiffness. The device thus reduces deflection in a floor resulting in less bounce and vibration.

The disclosed device is unique in that it is structurally different from other known devices or solutions. More specifically, the device is unique due to the presence of (1) Load bearing mounting brackets that have inbuilt tension rod receiver holes that allow the tension bolts to swivel into position until they are wound to the optimum tension force. (2) A fully adjustable and threaded structural tensioning bolt that receives and supports the tension bars and assists in keeping the bars from bending under tension. The tensioning bolt is a double-sided box section and is engineered with high-capacity sheer points, which more efficiently houses the energy of the tension force which is generated by winding out the tension rods and (3) High-capacity threaded tension rods with one end rounded for insertion into the mounting bracket receiver hole and the other end the driver end. The driver end has an external hex drive profile for easy winding in and out when using a spanner, wrench or impact driver. When combining the said mentioned components together as a system this device uses fewer pieces than other conventional braces, has a higher capacity to lift sagging floors and is cost effective.

This disclosure will now provide a more detailed and specific description that will refer to the accompanying drawings. The drawings and specific descriptions of the drawings, as well as any specific or alternative embodiments discussed, are intended to be read in conjunction with the entirety of this disclosure. The A structural connector for tensioning floor joists and beams may, however, be embodied in many different forms and should not be construed as being limited to the embodiments set forth herein; rather, these embodiments are provided by way of illustration only and so that this disclosure will be thorough, complete and fully convey understanding to those skilled in the art.

BRIEF DESCRIPTION OF THE DRAWINGS

FIG. 10 is a perspective view of an adjustable spanning member consisting of an assembled embodiment of a structural tensioning bolt and dual tension rods for the structural connector for tensioning joists and beams in FIG. 1.

FIG. 11 is a top view of an adjustable spanning member consisting of an assembled embodiment of a structural tensioning bolt and dual tension rods for the structural connector for tensioning joists and beams in FIG. 1.

DETAILED DESCRIPTION

The present invention is directed to a structural connector for tensioning floor joists and beams.

Figure 1:
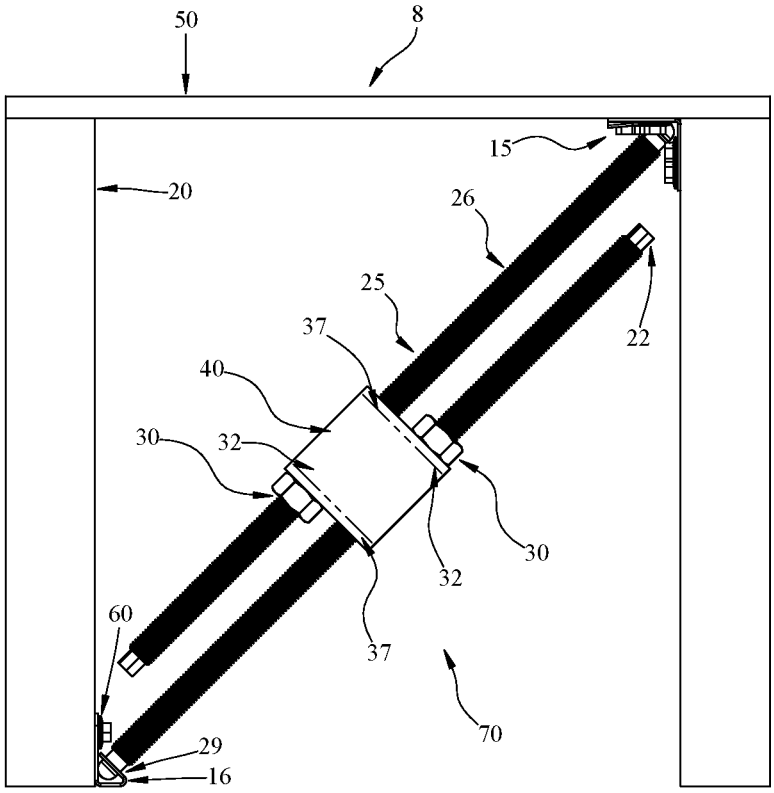
FIG. 1 is a side view of a structural connector for tensioning joists and beams in accordance with the present invention, installed between two adjacent joists.

Referring first to FIG. 1, a structural connector for tensioning joists and beams in accordance with the present invention is shown generally as 8.

In its most complete version, the device is made up of the following components. The structural connector for tensioning joists and beams 8 includes a pair of load bearing mounting brackets 15 and an adjustable spanning member 70 consisting of an assembled structural tensioning bolt 40 and dual tension rods 25. Each tension rod 25 is locked into a set position by a threaded nut 30.

The structural connector for tensioning joists and beams 8 is shown installed underneath a floor 50 between two adjacent joists 20 as a side view.

In the preferred embodiment, each load bearing mounting bracket 15 is constructed from a single piece of stamped sheet metal. The load bearing mounting bracket 15 may be manufactured in several different variations to accommodate tensions rods 25 and shim placement holders 18 as shown in FIGS. 1, 8 and 9.

Figure 8:
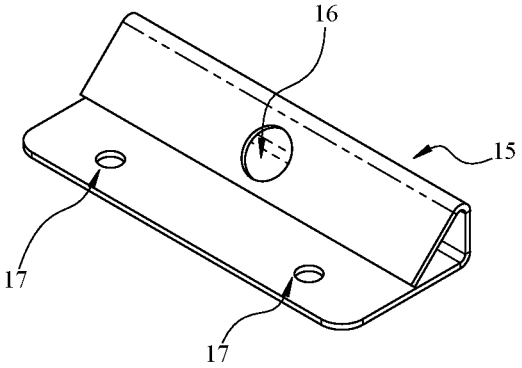
FIG. 8 is a perspective view of a load bearing mounting bracket for the structural connector for tensioning joists and beams in FIG. 1.
Figure 9:
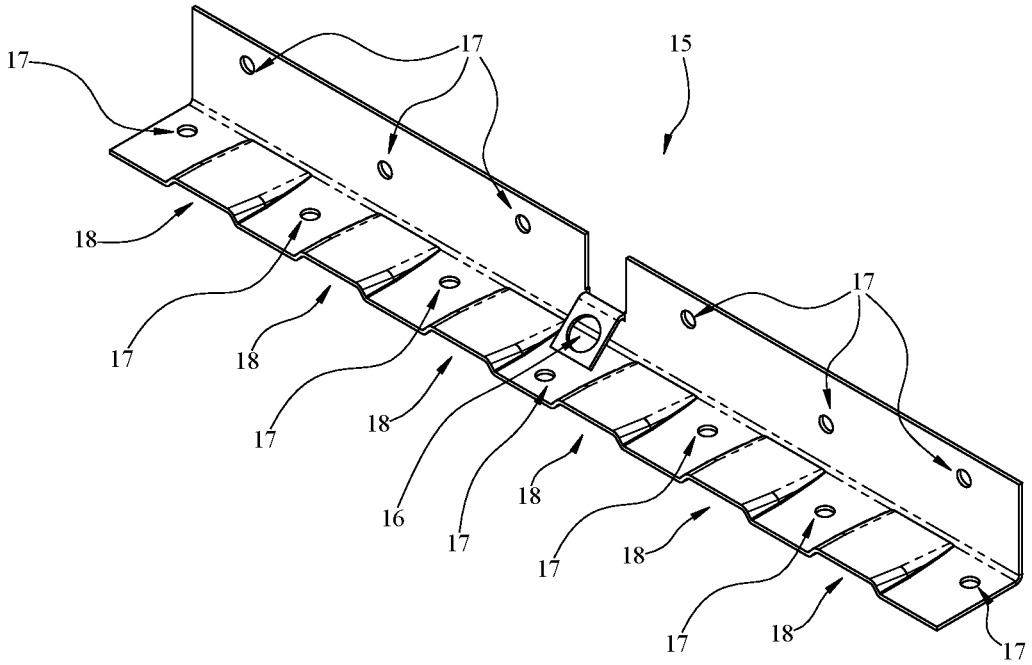
FIG. 9 is a perspective view of an alternative embodiment of the load bearing mounting bracket for the structural connector for tensioning joists and beams in FIG. 1.
Figure 12:
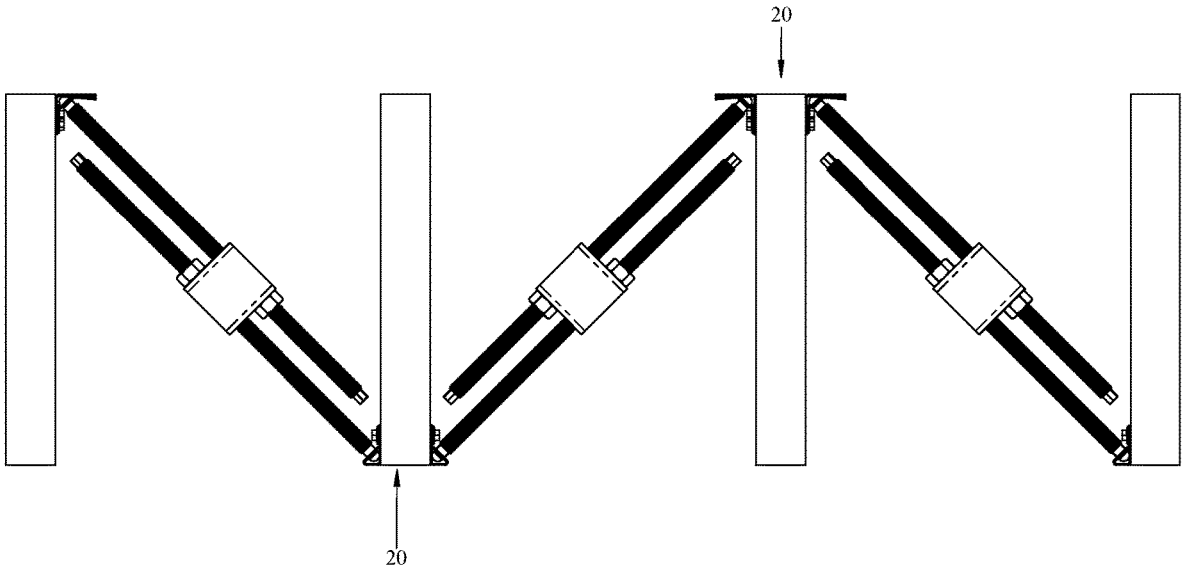
FIG. 12 is a side view of the structural connector for tensioning joists and beams installed between a series of floor joists.

As shown in FIGS. 1, 8 and 9, each load bearing mounting bracket has a rounded 45 degree opening 16 to receive a tension rod. The load bearing mounting bracket 15 contains a plurality of apertures 17 for the use of fasteners 60 such as screws and nails or the like to be securely attached to the joist 20 or beam. The load bearing mounting bracket 15 is installed each side of the joist 20 as shown in FIG. 12. The load bearing mounting brackets provide a cradle that strengthens the joists to be able to transfer the vertical load forces, dispersing bending moments and sheer forces across multiple joists. These forces travel from the joists to the supporting walls and down to the ground resulting in superior load bearing capacity over the whole floor.

Figure 2:
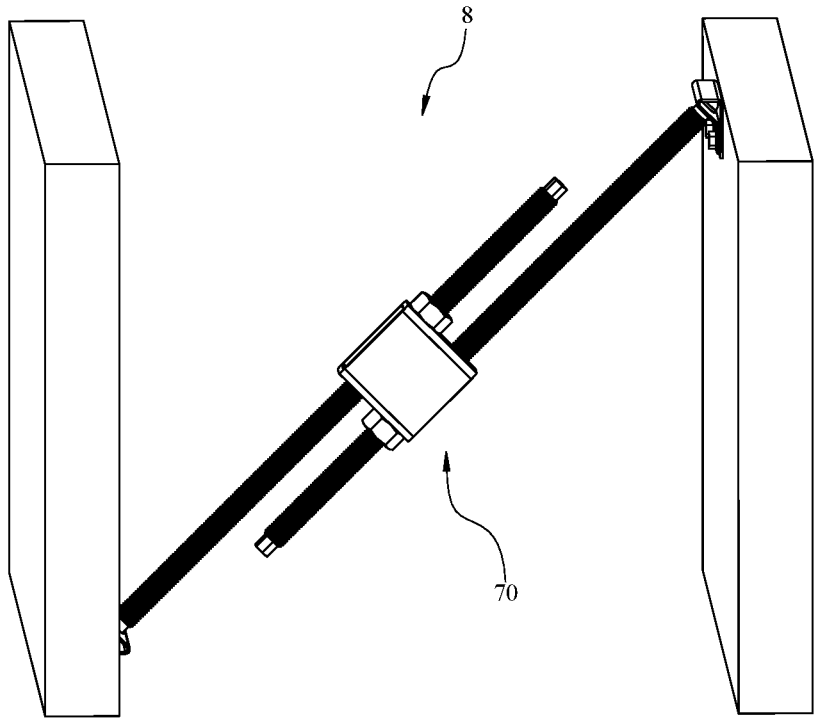
FIG. 2 is a perspective view of a structural connector for tensioning joists and beams in accordance with the present invention, installed between two adjacent joists.

FIG. 2 shows a perspective view of a structural connector for tensioning joists and beams 8 installed between two adjacent joists 20.

Figure 3:
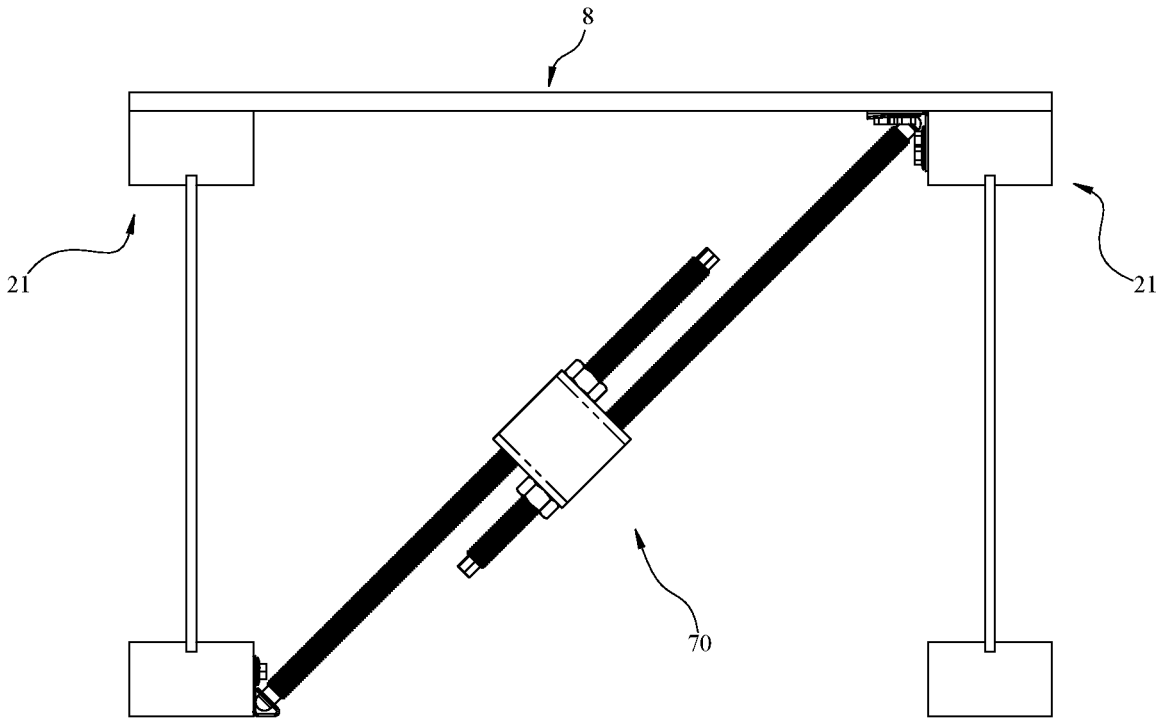
FIG. 3 is a side view of an alternative embodiment of a structural connector for tensioning joists and beams in accordance with the present invention, installed between two adjacent I-joists.

FIG. 3 shows a side view of a structural connector for tensioning joists 8 installed between two adjacent I-joists 21.

Figure 4:
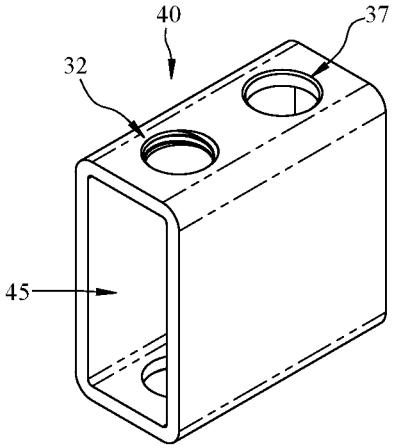
FIG. 4 is a perspective view of a structural tensioning bolt for the structural connector for tensioning joists and beams in FIG. 1.
Figure 5:
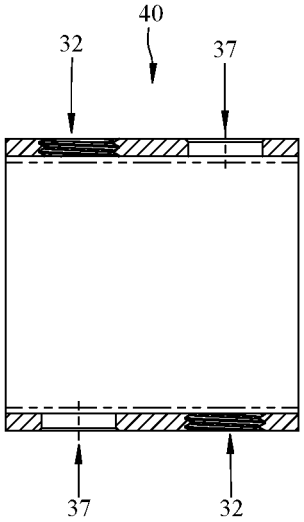
FIG. 5 is a side view of a structural tensioning bolt for the structural connector for tensioning joists and beams in FIG. 1.
Figure 6:
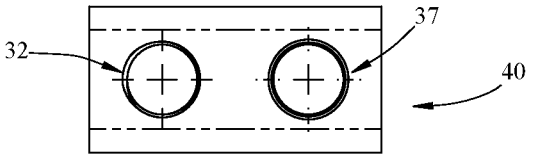
FIG. 6 is a top view of a structural tensioning bolt for the structural connector for tensioning joists and beams in FIG. 1.

FIG. 4 shows a perspective view, FIG. 5 shows a side view and FIG. 6 shows a top view of a structural tensioning bolt 40 for the structural connector 8 for tensioning joists and beams in FIG. 1.

The structural tensioning bolt 40 is comprised of a hollow rectangle structural steel section 45. Each end of the hollow rectangle structural steel section 45 has a female threaded hole 32 and a clear round hole 37 section. Both the female threaded hole 32 and the clear hole section 37 receives the threaded 26 tension rod 25 as shown in FIGS. 7, 10 and 11.

The structural tensioning bolt 40 supports the bars and assists in keeping the bars 25 from bending under tension. The double-sided box section is engineered with high-capacity sheer points, which more efficiently houses the energy of the tension force. Tension force is generated by winding out the tension rods 25 which are connected at the ends of the mounting bracket 15 which are fastened 60 to the Joists 20 and or beams.

Figure 7:
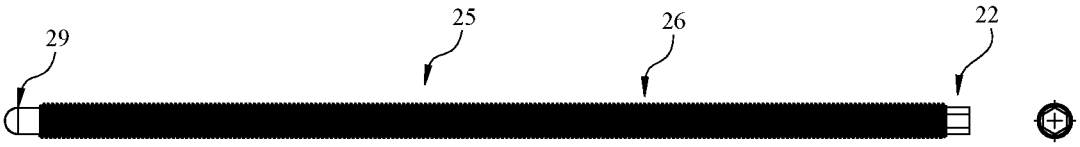
FIG. 7 is side view of a tension rod for the structural connector for tensioning joists and beams in FIG. 1.

FIG. 7 is a side view of a tension rod 25 for the structural connector 8 for tensioning joists and beams in FIG. 1. The tension rod 25 is threaded 26 with one end being rounded 29 to fit inside the load bearing mounting bracket rounded opening 16. The other end of the tension rod 25 has an external hex drive profile that allows an attachment for a spanner, wrench or impact driver.

The male threaded tension rod 25 is wound through the female threaded 32 structural tensioning bolt and continues through the clear hole 37 section as shown in FIGS. 10 and 11.

The structural tensioning bolt 40 mated with the threaded tension rods 25 and locked into position by the locking nut 30 as shown in FIG. 7 provides an adjustable spanning member 70.

FIG. 10 shows a perspective view and FIG. 11 shows a top view of an adjustable spanning member 70 which is an assembled embodiment of a structural tensioning bolt and dual tension rods for the structural connector for tensioning joists and beams in FIG. 1.

The adjustable spanning member 70 can be wound in or wound out to accommodate different spans and heights between the pair of adjacent joists.

FIG. 12 is a side view of the structural connector for tensioning joists and beams installed between a series of floor joists.

Different features, variations and multiple different embodiments have been shown and described with various details. What has been described in this application at times in terms of specific embodiments is done for illustrative purposes only and without the intent to limit or suggest that what has been conceived is only one embodiment or specific embodiments. It is to be understood that this disclosure is not limited to any single specific embodiments or enumerated variations. Many modifications, variations and other embodiments will come to mind of those skilled in the art, and which are intended to be and are in fact covered by both this disclosure. It is indeed intended that the scope of this disclosure should be determined by a proper legal interpretation and construction of the disclosure, including equivalents, as understood by those of skill in the art relying upon the complete disclosure present at the time of filing.

What is claims is:

1. A structural tensioning bolt comprising:

a hollow rectangle structural steel section having two ends, each end having a female threaded hole and a clear round hole which receive two threaded tension rods, each rod extending through one of the threaded holes and through one of the clear holes in each end of the hollow rectangle structural steel section;

one of the two threaded tension rods having two ends, with one end extending inside an opening of a first mounting bracket, the first mounting bracket being attached to a joist, and the other end having an external hex drive profile for a tool to be attached for rotating the tension rod, and the other of the two threaded tension rods having two ends, with one end extending inside an opening of a second mounting bracket, the second mounting bracket being attached to an adjacent joist, and the other end of the tension rod having an external hex drive profile for a tool to be attached for rotating the tension rod, and each tension rod being locked into a set tensioned position by a threaded nut.

2. The structural connector of claim 1 wherein the two rods are arranged so the rounded ends are opposite each other.

3. The structural connector of claim 2 wherein the structural connector is used to provide tension between two adjacent joists and the rounded end of each tension rod is received by a round hole of a pair of mounting brackets attached to the adjacent joists.

* * * * *